US006057802A

United States Patent [19]

Nealy et al.

[11] Patent Number: 6,057,802

[45] Date of Patent: May 2, 2000

[54] TRIMMED FOURSQUARE ANTENNA RADIATING ELEMENT

[75] Inventors: J. Randall Nealy, Christianburg; J. Matthew Monkevich, Blacksburg; Warren L. Stutzman, Blacksburg; William A. Davis, Blacksburg, all of Va.

[73] Assignee: Virginia Tech Intellectual Properties, Inc., Blacksburg, Va.

[21] Appl. No.: 09/326,688

[22] Filed: Jun. 7, 1999

Related U.S. Application Data

[63] Continuation-in-part of application No. 08/885,837, Jun. 30, 1997, Pat. No. 5,926,137.

[51] Int. Cl.[7] ..... H01Q 21/00; H01Q 1/40; H01Q 1/42

[52] U.S. Cl. ..... 343/700 MS; 343/853; 343/872; 343/873

[58] Field of Search ..... 343/700 MS, 853, 343/872, 873

[56] References Cited

U.S. PATENT DOCUMENTS 5,001,493 3/1991 Patin et al. ..... 343/700 MS 5,510,803 4/1996 Ishizaka et al. ..... 343/700 MS

*Primary Examiner*—Frank G. Font
*Assistant Examiner*—Roy M. Punnoose
*Attorney, Agent, or Firm*—Whitham, Curtis & Whitham

[57] ABSTRACT

A foursquare dual polarized moderately wide bandwidth antenna radiating element is provided which, due to its small size and low frequency response, is well suited to array applications. The foursquare element comprises a printed metalization on a low-loss substrate suspended over a ground plane reflector. Dual linear (i.e., horizontal and vertical), as well as circular and elliptical polarizations of any orientation may be produced with the inventive foursquare element. Further, an array of such elements can be modulated to produce a highly directive beam which can be scanned by adjusting the relative phase of the elements. Operation of the array is enhanced because the individual foursquare elements are small as compared to conventional array element having comparable frequency response. The small size allows for closer spacing of the individual elements which facilitates scanning. Additionally, a family of trimmed foursquare antennas is provided which offer improved performance and size considerations.

13 Claims, 15 Drawing Sheets

TRIMMED FOURSQUARE ANTENNA RADIATING ELEMENT

CROSS-REFERENCE TO RELATED APPLICATIONS

This application is a continuation-in-part (CIP) of U.S. application Ser. No. 08/885,837, filed on Jun. 30, 1997, now U.S. Pat. No. 5,926,137, herein incorporated by reference.

BACKGROUND OF THE INVENTION

1. Field of the Invention

The present invention generally relates to an antenna radiating element and, more particularly, to a foursquare antenna element which can provide dual polarization useful in, for example, compact, wideband radar and communication antenna arrays.

2. Description of the Related Art

An antenna is a transducer between free space propagation and guided wave propagation of electromagnetic waves. During a transmission, the antenna concentrates radiated energy into a shaped directive beam which illuminates targets in a desired direction. In a radar system, the target is some physical object, the presence of which is to be determined. In a communication system, the target may be a receiving antenna.

During reception, the antenna collects energy from the free space propagation. In a radar system, this energy comprises a signal reflected back to the antenna from a target. Hence, in a radar system, a single antenna may be used to both transmit and receive signals. Likewise in a communication system an antenna may serve the dual functions of transmitting and receiving signals from a remote antenna. In a radar system, the primary purpose of the antenna is to determine the angular direction of the target. A highly directive, narrow beam-width is needed in order to accurately determine angular direction as well as to resolve multiple targets in physically close proximity to one another.

Phased array antenna systems are formed from an arrayed combination of multiple, individual, similar radiator elements. The phased array antenna characteristics are determined by the geometry and the relative positioning of the individual elements and the phase and amplitude of their excitation. The phased array antenna aperture is assembled from the individual radiating elements, such as, for example, dipoles or slots. By individually controlling the phase and amplitude of the elements very predictable radiation patterns and beam directions can be realized. The antenna aperture refers to the physical area projected on a plane perpendicular to the main beam direction. Briefly, there are several important parameters which govern antenna performance. These include the radiation pattern (including polarization), gain, and the antenna impedance.

The radiation pattern refers to the electromagnetic energy distribution in three-dimensional angular space. When normalized and plotted, it is referred to as the antenna radiation pattern. The direction of polarization of an antenna is defined as the direction of the electric field (E-field) vector. Typically, a radar antenna is linearly polarized, in either the horizontal or the vertical direction using earth as a reference. However, circular and elliptical polarizations are also common. In circular polarization, the E-field varies with time at any fixed observation point, tracing a circular locus once per RF (radio frequency) cycle in a fixed plane normal to the direction of propagation. Circular polarization is useful, for example, to detect aircraft targets in the rain. Similarly, elliptical polarization traces an elliptical locus once per RF cycle.

Gain comprises directive gain (referred to as "directivity" $G_D$) and power gain (referred to as simply "gain" G) and relates to the ability of the antenna to concentrate energy in a narrow angular regions. Directive gain, or directivity, is defined as the maximum beam radiation intensity relative to the average intensity, usually given in units of watts per steradian. Directional gain may also be expressed as maximum radiated power density (i.e., watts/meter$^2$) at a far field distance R relative to the average density at the same distance. Power gain, or simply gain, is defined as power accepted at by the antenna input port, rather than radiated power. The directivity gain and the power gain are related by the radiation efficiency factor of the antenna. For an ideal antenna, with a radiation efficiency factor of 1, the directional gain and the power gain are the same (i.e., $G=G_D$).

Antenna input impedance is made up of the resistive and reactive components presented at the antenna feed. The resistive component is the result of antenna radiation and ohmic losses. The reactive component is the result of stored energy in the antenna. In broad band antennas it is desirable for the resistive component to be constant with frequency and have a moderate value (50 Ohms, for example). The magnitude of the reactive component should be small (ideally zero). For most antennas the reactive component is small over a limited frequency range.

Phased array antennas capable of scanning have been know for some time. However, phased array antennas have had a resurgence for modem applications with the introduction of electronically controlled phase shifters and switches. Electronic control allows aperture excitement to be modulated by controlling the phase of the individual elements to realize beams that are scanned electronically. General information on phased array antennas and scanning principles can be gleaned from Merrill Skolnik, Radar Handbook, second edition, McGraw-Hill, 1990, herein incorporated by reference. Phased array antennas lend themselves particularly well to radar and directional communication applications.

Since the impedance and radiation pattern of a radiator in an array are determined predominantly by the array geometry, the radiating element should be chosen to suit the feed system and the physical requirements of the antenna. The most commonly used radiators for phased arrays are dipoles, slots, open-ended waveguides (or small horns), and printed-circuit "patches". The element has to be small enough to fit in the array geometry, thereby limiting the element to an area of a little more than $\lambda/4$, where $\lambda$ is wavelength. In addition, since the antenna operates by aggregating the contribution of each small radiator element at a distance, many radiators are required for the antenna to be effective. Hence, the radiating element should be inexpensive and reliable and have identical, predictable characteristics from unit to unit.

Radiator elements such as the "four arm sinuous log-periodic", described in U.S. Pat. No. 4,658,262 to DuHamel, and the Archaemedian spiral, which have wide bandwidths and are otherwise desirable for array applications have diameters greater than 0.43 $\lambda$ at their lowest frequency. With a bandwidth in excess of 1.5:1 in a square grid array an interelement spacing of about 0.33 $\lambda$ is desired.

SUMMARY OF THE INVENTION

It is therefore an object of the present invention to provide an antenna radiating element which is suitable for use in radar and communication applications.

It is yet another object of the present invention to provide a foursquare dual polarized radiating element having a wide bandwidth.

It is yet another object of the present invention to provide an antenna element that is smaller than other antenna elements having the same low frequency response and therefore can be placed closer to other elements in an array.

According to the invention, a foursquare dual polarized moderately wide bandwidth antenna radiating element is provided which, due to its small size and low frequency response, is well suited to array applications. The foursquare element comprises a printed metalization on a low-loss substrate suspended over a ground plane reflector. Dual linear (i.e., horizontal and vertical), as well as circular and elliptical polarizations of any orientation may be produced with the inventive foursquare element. Further, an array of such elements can be modulated to produce a highly directive beam which can be scanned by adjusting the relative phase of the elements. Operation of the array is enhanced because the individual foursquare elements are small as compared to conventional array element having comparable frequency response. The small size allows for closer spacing of the individual elements which facilitates scanning. Bandwidths of 1.5:1 or better may be obtained with a feed point impedance of 50 Ohms. Good performance is obtained with the foursquare element having a size between 0.30 $\lambda$ and 0.40 $\lambda$ and preferably of 0.36 $\lambda$. Also the foursquare element impedance degrades gradually in contrast to some elements such as the "four arm sinuous log-periodic" which has large impedance variations near its lowest frequency.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
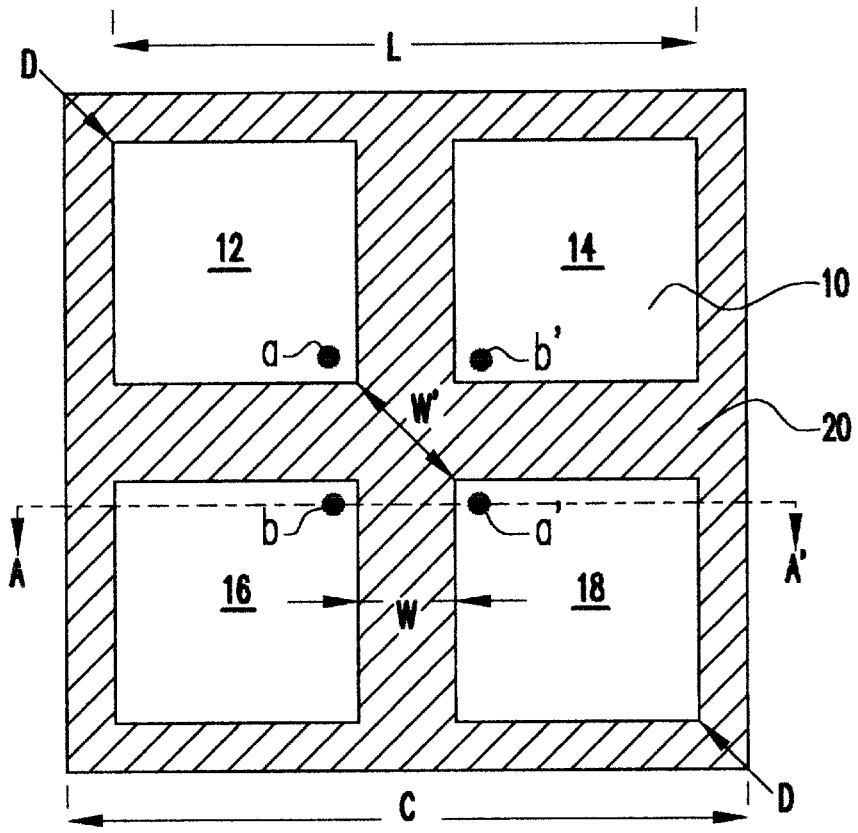
FIGS. 1A and 1B is a top view, and a cross-sectional view of the foursquare element according to the present invention, respectively.
Figure 1B:
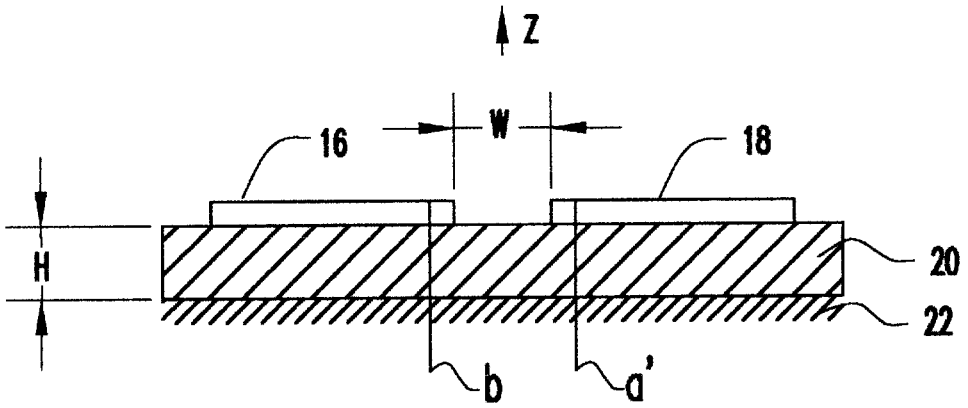

Referring now to the drawings, and more particularly to FIGS. 1A and 1B, there is shown a top view of the foursquare element 10 according to the present invention, and a cross sectional view taken along line A—A', respectively. The foursquare element 10 comprises a four small square metalization regions 12, 14, 16, and 18 (petals) printed on a low loss substrate 20. The low loss substrate 20 may be secured to a ground plane. Each of the small square regions 12, 14, 16, and 18, are separated by a narrow gap W on two sides and by a gap W' in the diagonal. Each element is fed by balanced feed lines a—a' and b—b' attached at or near the center of the element diagonally across the gap W'. Since there are two identical and balanced element halves arranged in a cross pattern along the diagonal W', the element halves (i.e., 12 and 18, or 14 and 16) can be fed independently with either the same or different frequencies. In order to feed the entire element, either two independent transmission lines or a balanced four wire transmission line is needed. The foursquare element 10 can therefore be used to produce dual linear (i.e., vertical or horizontal polarization) or circular polarization of either sense similar to crossed dipoles. Appropriate feeding of the crossed element in the foursquare antenna can be used to produce various angles of linear or elliptical polarization.

For example, linear polarization may be obtained by feeding either element half (e.g., 12 and 18, or 14 and 16) diagonally across the gap W'. In this case the polarization will be in line with the diagonal of the feed. Other linear polarizations may be obtained by feeding both element halves in phase with one another. The angle of the polarization is determined by the relative amplitude of the sources. Circular polarization is obtained by feeding the crossed element halves in phase quadrature (i.e. 90 degree relationship) and equal amplitude.

The foursquare element 10 of the present invention can be arranged into an array to produce a highly directive beam. The array beam can then be scanned by adjusting the relative phase of the elements according to conventional practice. The foursquare element 10 has the advantage of allowing relatively close spacing of adjacent elements, by arranging the elements so that the element sides are parallel to one another. When the elements are placed in this manner the principal polarization planes are diagonal to the sides of the array. If other polarization orientations are desired the array can be rotated. By applying excitation to the crossed element pairs (12 and 18, or 14 and 16) with equal and in-phase currents, a composite polarization oriented along the side of the elements and the array is produced. Other polarizations are produced in a similar manner.

Individual elements 10 or arrays of the foursquare antenna can be operated either with or without a conductive ground plane 22. Using a ground plane 22 will produce a unidirectional pattern. Ground plane spacings H of ¼ wavelength ($\lambda/4$) or less are appropriate and should be chosen with regard to the required feed point (a, a', b, and b') impedance characteristics, scanning characteristics and the dielectric characteristics of the substrate 20. A reasonable choice would be a spacing H of $\lambda/4$ at the highest frequency used when the substrate 20 is air. If the substrate 20 is composed of a dielectric material other than air the spacing H is approximately $\lambda/4$ (again at the highest frequency) divided by the square root of the relative permittivity $\epsilon_R$ of the substrate 20.

The frequency range of the foursquare element 10 is limited to less than a 2:1 range by the low input resistance, increasing capacitive reactance at the lowest operating frequency, and by the rapid rise in impedance or anti-resonance which occurs at the high frequency end.

Some narrow band applications may be able to extend the low frequency response by use of conventional matching techniques. The lowest frequency of operation for the element occurs when the diagonal of the square element is approximately ½ wavelength ($\lambda/2$). The anti-resonance which limits the high frequency response occurs when the diagonal D across the element 10 becomes approximately one wavelength ($D \approx \lambda$). The anti-resonance may not be approached closely however because of the rapidly increasing reactance. An early test element placed over a ground plane gave a bandwidth of about 1.5:1 with the limits taken at a voltage standing wave ratio (vswr) of 2. This bandwidth would be typical of an uncompensated foursquare element.

Figure 2:
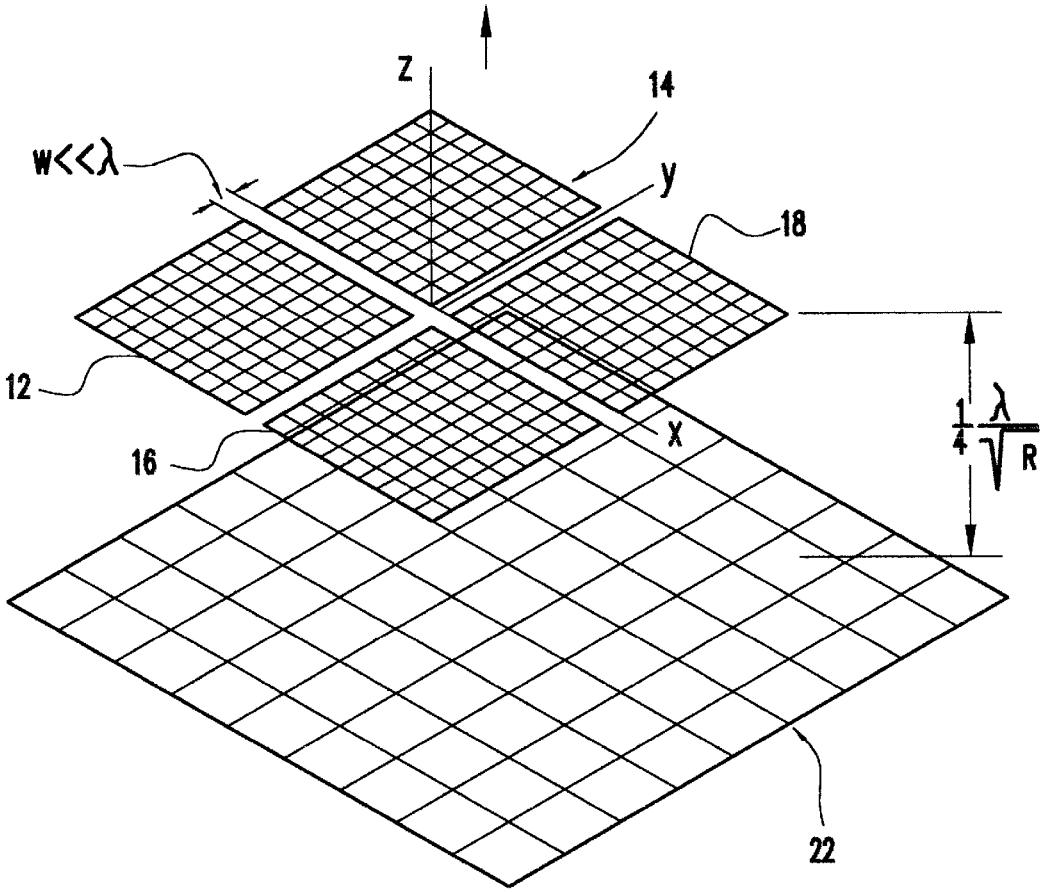
FIG. 2 is a perspective view foursquare antenna element.

FIG. 2 shows a perspective view of the foursquare element according to the present invention superimposed on a Cartesian origin. The perspective view is shown in wire grid representation for illustrative purposes; however, typically the elements would be solid printed metalizations. The ground plane 22 lies parallel to the x-y plane and parallel to the plane of the elements 12, 14, 16, and 18. The elements are typically printed in a dielectric substrate (not shown) having a approximate thickness of $\lambda/4$. The feed is diagonal across the origin. The direction of maximum radiation is in the z direction.

Figure 3:
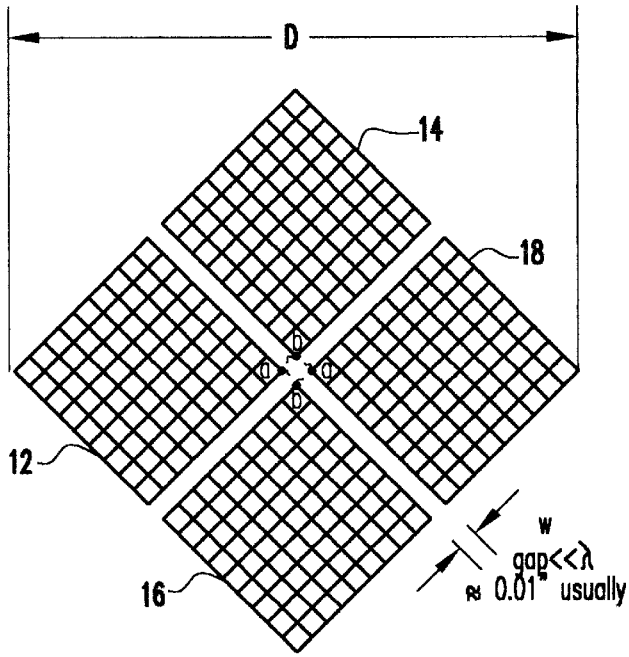
FIG. 3 is a top view of the foursquare antenna element showing the feed points for various polarizations.

FIG. 3 shows a top view of the foursquare element according to the present invention. As shown, the size of the diagonal D across the element 10 is approximately $\lambda/2$ at the lowest frequency. The gap W between the metalized regions 12,14, 16, and 18 is typically much less than $\lambda$ (e.g. 0.01 inches with $\lambda$=6 cm) but is not strongly frequency dependent. Experimental evidence shows that adjusting the gap width W is useful for controlling the feed point impedance. For a horizontal polarization, a transmission feed line is connected across feed a—a'. Similarly, connecting across b—b' gives a vertical polarization. By connecting feedlines to both a—a' and b—b' other polarizations can be produced. For example if both the horizontal and vertical element halves are fed in phase (a relative phase of 0°) and with equal amplitudes a polarization angle of 45° is produced. If the horizontal and vertical elements are fed with a relative phase of 90° and equal amplitudes a circularly polarized wave results. Elliptical polarized waves, although usually undesired, are also created with a 90° relative phase but unequal amplitudes.

Referring back to FIGS. 1A and 1B, by way of example, a prototype has been built for the four square element having an overall element width of C=0.86 inches, a metalization width of L=0.84 inches, a gap width W=0.01 inches, and a ground plane spacing H=0.278 inches. The substrate 20 was a layered composite material consisting of an upper layer of glass microfiber reinforced polytetrafluoroethylene, such as RT/duroid® 5870 having a thickness of 0.028 inches with 1 oz. copper cladding and a lower layer of polystyrene foam having a thickness of 0.250 inches. The four metalized regions 12, 14, 16, and 18, were etched onto the copper clad upper layer.

A foursquare element has also been constructed on a solid substrate 20 of polystyrene cross linked with divinylbenzene, such as Rexolite®. Another possible construction is a substrate of solid polystyrene foam or polyethylene foam with metal tape elements 12, 14, 16, and 18. Still another method is to construct the metalization regions 12, 14, 16, and 18 from metal plates suspended above the ground plane 22 with dielectric standoffs.

Figure 4:
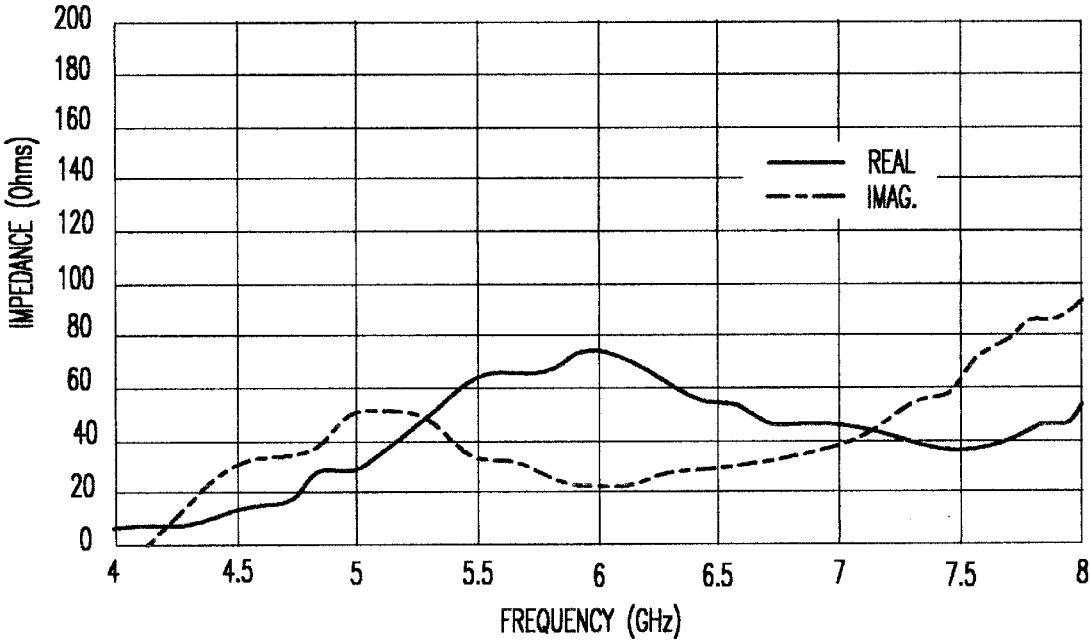
FIG. 4 is a feed point impedance plot for the foursquare antenna element.

FIG. 4 shows the feed point impedance plot for the foursquare element above. This plot demonstrates the broad band nature of the element. The gradual decline of the real component toward the lower end of the frequency range as well as the rise in reactance on the high frequency end represents the limitation in frequency response of the element.

Figure 5:
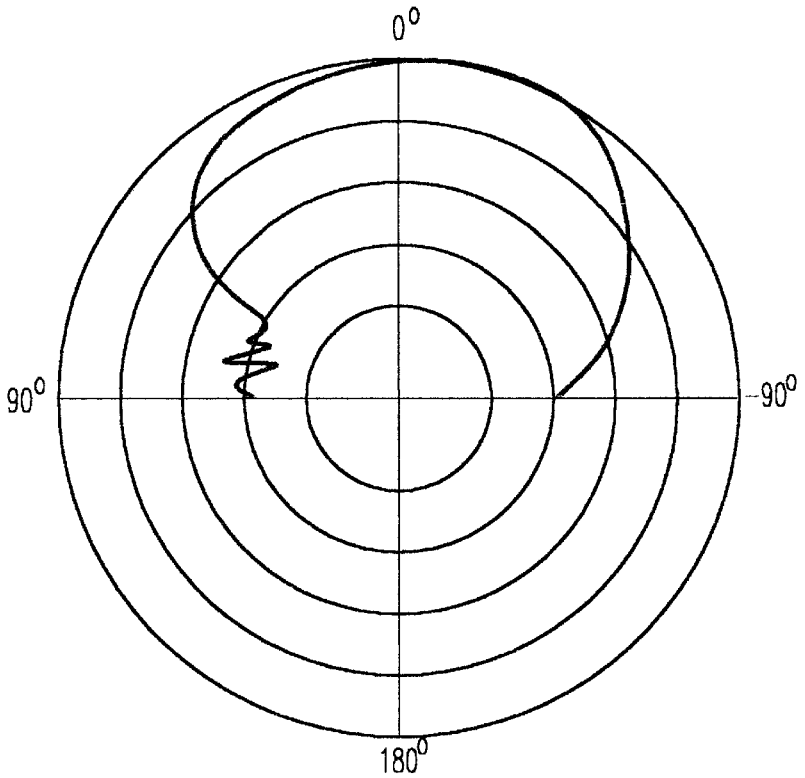
FIG. 5 is a mid-band E plane radiation pattern for the foursquare element.
Figure 6:
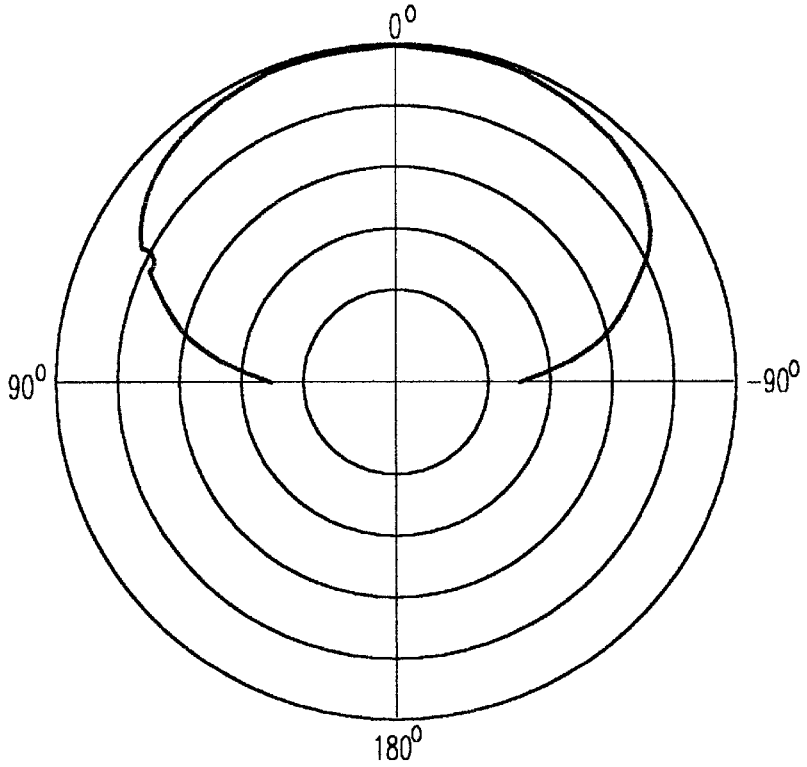
FIG. 6 is a mid-band H plane radiation pattern for the foursquare element.

FIGS. 5 and 6 are the mid-band E and H plane radiation patterns for the four square element, respectively. Both planes demonstrate the clean wide beam pattern required for phased array applications. Other frequencies in the element pass band show similar radiation patterns.

Figure 7:
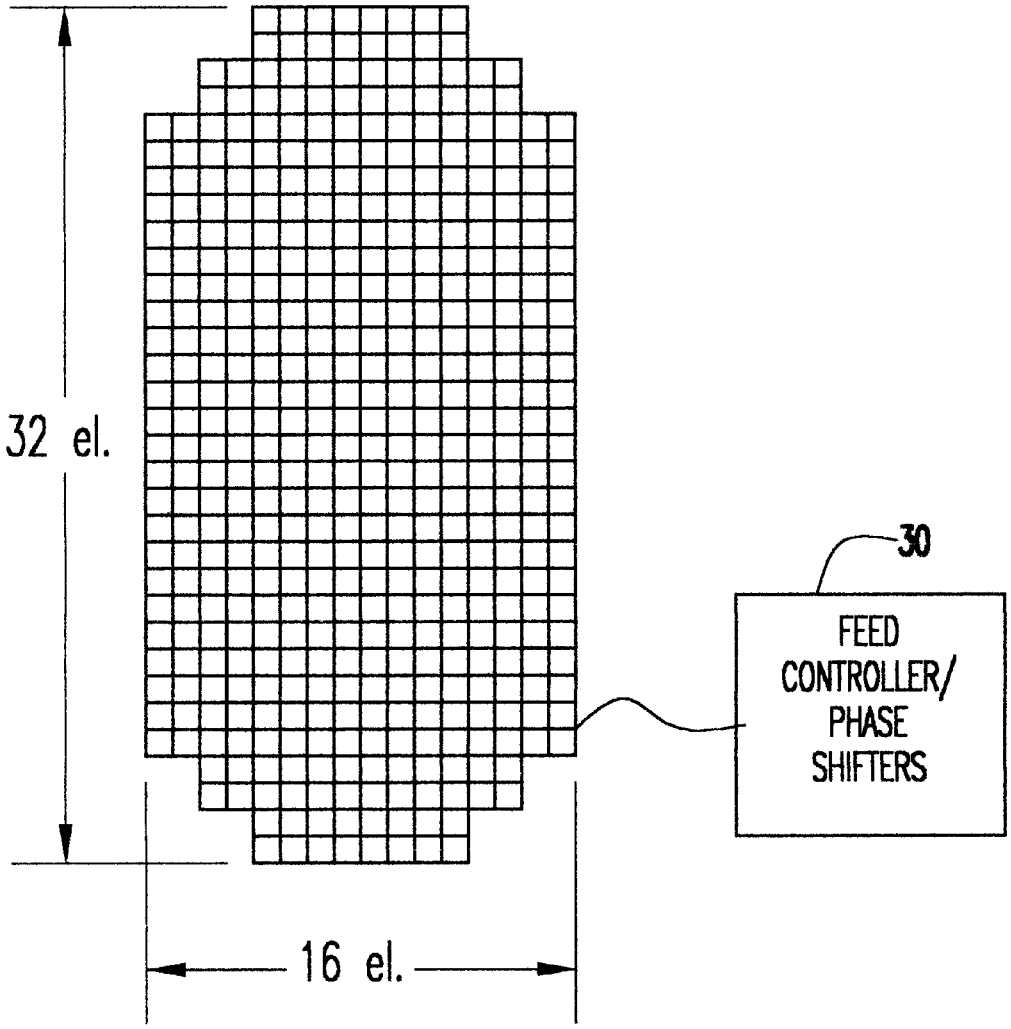
FIG. 7 is an illustrative geometry of a fully array comprised of many foursquare elements.

FIG. 7 is an illustrative geometry of a full array comprised of many foursquare elements. This particular array geometry is suitable for use in a radar system. Each small square represents an individual foursquare element. Each foursquare element has an individual set of feed lines and phase shifters. The foursquare elements, feed lines and phase shifters are the connected via a corporate feed controller 30 to transmitting and receiving systems. By adjusting the phase shifters the direction of the beam is scanned.

Figure 8:
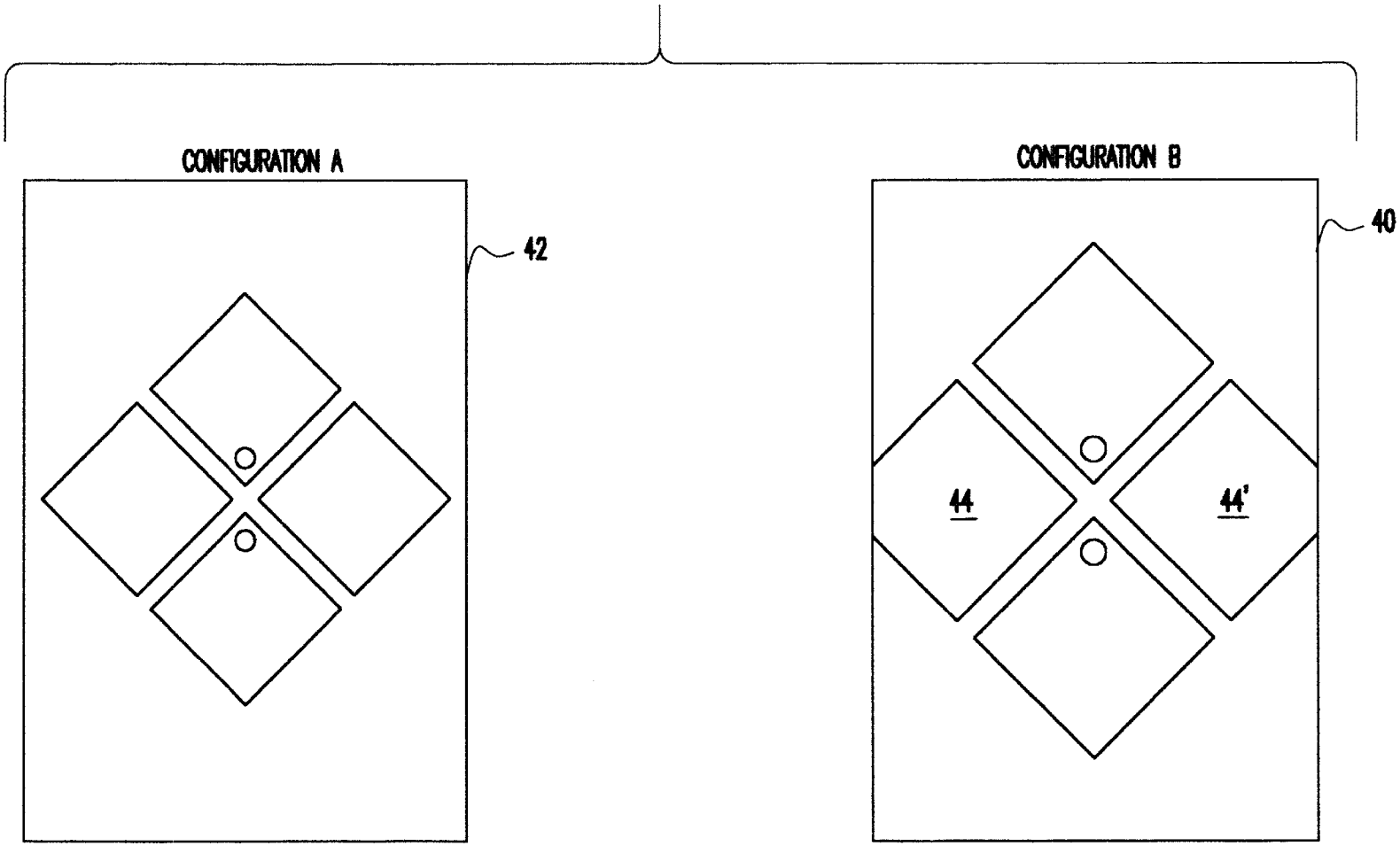
FIG. 8 is a top view of a second embodiment of the present invention comprising a trimmed four-square antenna element configuration.

FIG. 8 shows a top view of a second embodiment of the present invention comprising a trimmed four-square configuration 40. The basic construction of the trimmed foursquare is the same as the foursquare element 42 described above except that the ends or outer corners of one pair of plates, 44 and 44', are trimmed.

The overall size of an array element is determined by the frequency of operation. In an array of radiating elements the spacing between elements is determined by array geometry and other parameters which usually require elements to be closely packed together. These parameters often conflict in array design. The trimmed foursquare element 40 is useful for array requirements in which the broad frequency bandwidth characteristics of the foursquare element 42 are desired but the dimensions allowed by the array geometry were insufficient to accommodate the element in one dimension.

Still referring to FIG. 8, configuration 42 is a foursquare element as described above. The trimmed configuration 40; however, allows for a greater size in the vertical dimension. This arrangement allows the frequency of operation of the trimmed to be lower than with then with the untrimmed foursquare antenna 42. The drawback is that only the vertical polarization is supported without compromise. Some use may be made of the horizontal portion of the element if reduced frequency coverage is accepted. In the vertical polarization the trimmed foursquare has 40 a frequency response equal to or better than the foursquare element 42. The radiation patterns and gain characteristics are also equal to the conventional element.

Figure 9:
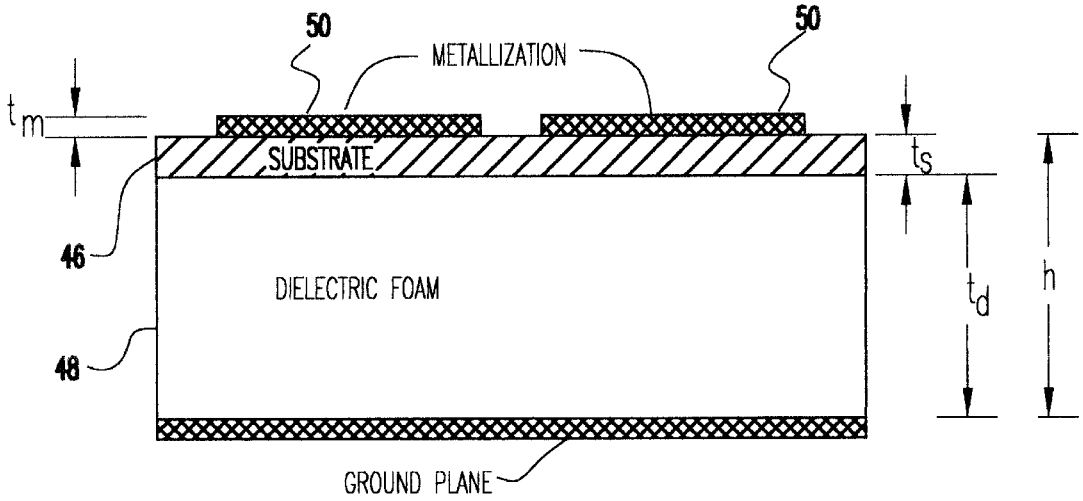
FIG. 9 is a cross-sectional view of the trimmed four-square antenna element.
Figure 10:
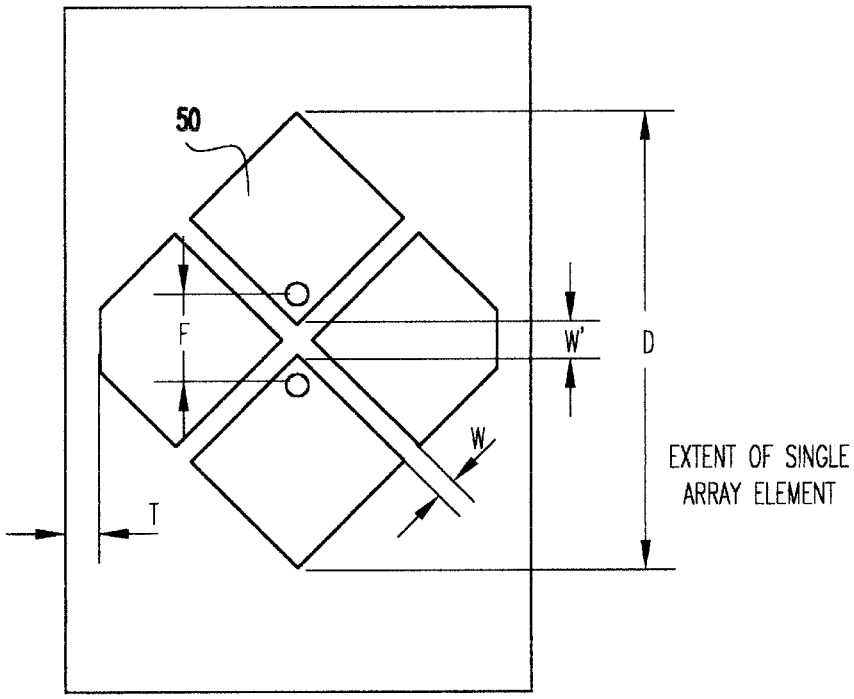
FIG. 10 is a top view showing the geometry of the trimmed four-square antenna element.

In a tested example as described below, the reduction in the horizontal dimension is approximately 15%. Reductions in the horizontal dimension of 25% or even 50% should also be possible. Details of the Trimmed Foursquare construction are shown in FIGS. 9 and 10. A summary of the parameter values is given in Table 1. The primary design guidelines are as follows:

1) Select the substrate 46 and dielectric foam 48 thickness so that the metallization 50 is approximately a quarter-wavelength (at the high frequency) above the ground plane ($h=0.25\ \lambda$).

2) Print the metallization 50 on the substrate so that the diagonal distance (D) is approximately one half-wavelength (at the low frequency).

3) Feed the foursquare element so that F is as small as physically possible (ideally, F=W').

4) The input impedance of the foursquare element is partially determined by the gap width W. The gap is similar to a slotline transmission line.

The parasitic (undriven) arms of an untrimmed foursquare are identical to the driven arms. In this application the parasitic arms extended beyond the element extents. Therefore, it was necessary to trim the parasitic arms. This was done in order to fit the element in the array lattice. Since the element is only being excited for linear polarization, this trimming does not adversely affect the performance of the element.

| Parameter | Symbol | Quantity |
|---|---|---|
| diagonal distance | D | ≈ ½ wavelength at min. frequency |
| distance between feed points | F | 0.086 inches |
| gap width | W | 10 mils |
| diagonal gap width | W' | 14.142 mils |
| thickness of metallization | $t_m$ | e.g. 1 oz. Copper |
| thickness of substrate | $t_s$ | 28 mils (e.g. Duroid ®) |
| thickness of dielectric foam | $t_d$ | $h-t_s$ |
| height above ground plane | h | ≈ ¼ wavelength at max. frequency |
| trim margin | t | 10 mils |

Of course it is understood that the above parameters are offered as an example and should not be taken to limit the invention in any manner.

Figure 11:
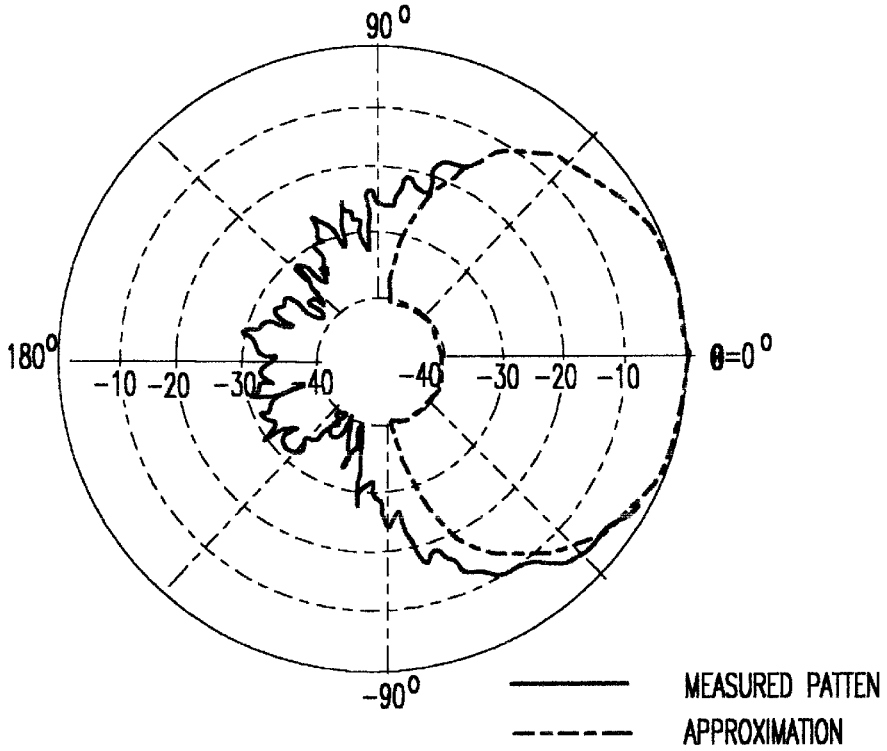
FIG. 11 is an E-plane co-polarized pattern of the trimmed foursquare for midband.
Figure 12:
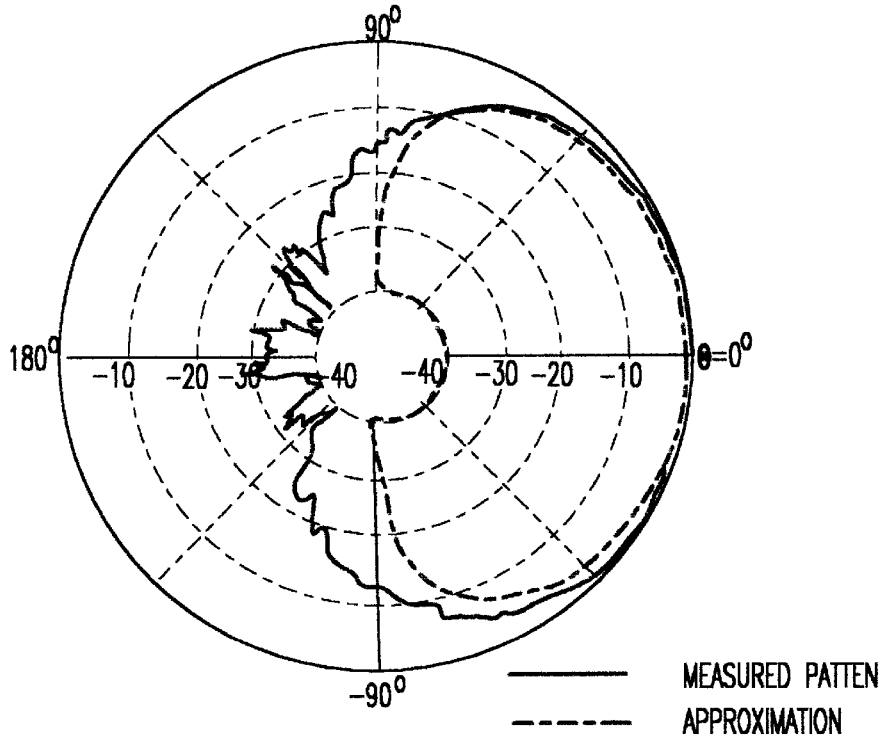
FIG. 12 is an H-plane co-polarized pattern of the trimmed foursquare for midband.

E-plane and H-plane co-polarized patterns of the trimmed foursquare for midband are shown in FIGS. 11 and 12, respectively. Additionally, the patterns are approximated using a $\cos^q(\theta)$ pattern (for 0<0<90°). The approximated patterns are plotted along with the measured data. The value for q is calculated using $$q = \frac{\log(F(\theta))}{\log(\cos(\theta))}$$

where θ is taken at the −10 dB points. The $\cos^q(\theta)$ pattern assumes no backplane radiation. Therefore, it should overestimate the directivity slightly.

Figure 13:
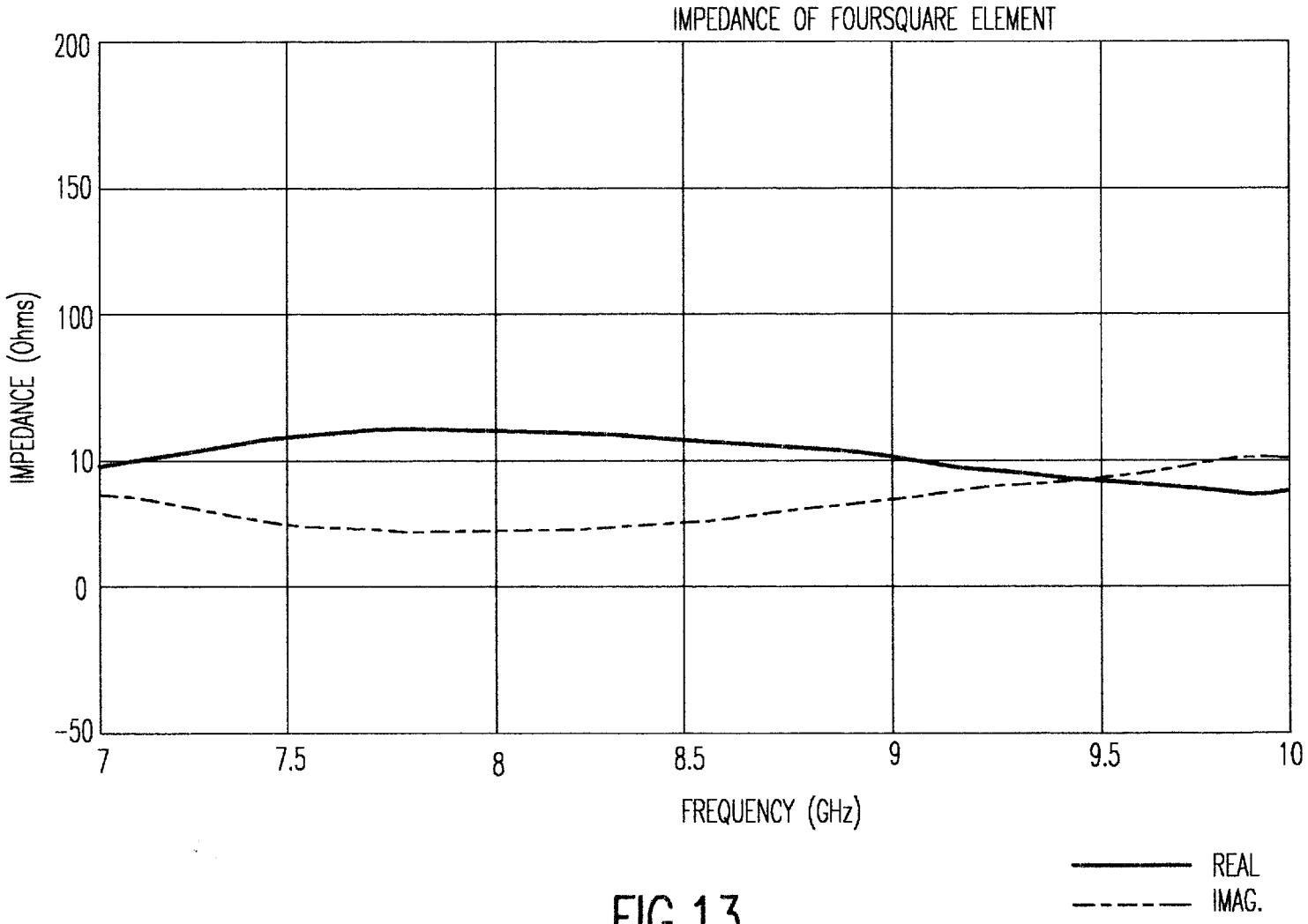
FIG. 13 is a graph showing the trimmed four-square input impedance.

As shown in FIG. 13 the impedance characteristics of the trimmed foursquare antenna are equal to or better than the untrimmed version.

FIGS. 14–33 show various alternative embodiments comprising different ways of trimming the basic foursquare antenna as described above. The individual elements in all of the variations retain at least two perpendicular sides owing to its model square shape.

Figure 14:
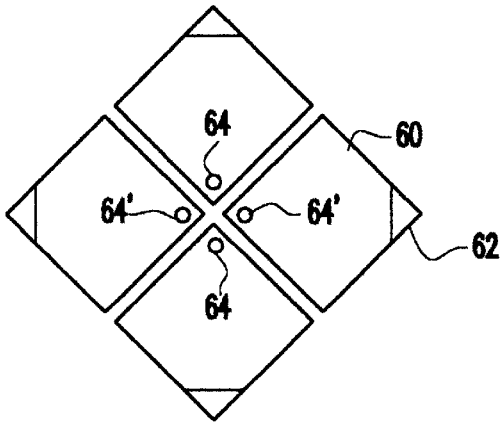
FIGS. 14–35 show various alternative embodiments comprising different ways of trimming the basic foursquare antenna as described above.
Figure 15:
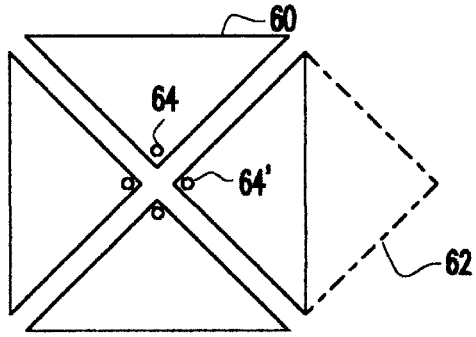

FIG. 14 shows the foursquare antenna element with all of the corners of it petals 60 trimmed. The dashed lines 62 illustrate the trimmed portion. When both pair of feeds 64 and 64' are feed, the frequency response of both polarizations will be modified. It is theorized that the frequency response will improve with trimming. FIG. 15 shows trimming taken to the extreme where the entire corner of the petal 60 is trimmed.

Figure 16:
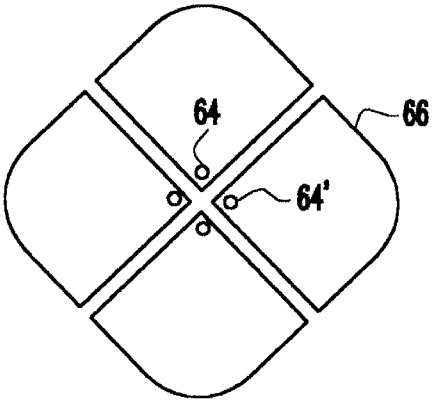
Figure 17:
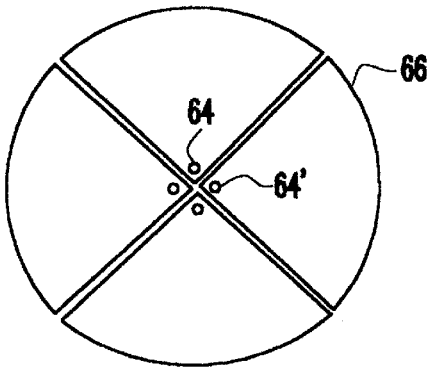

Similar to FIGS. 16 and 17 shows rounded outer petal corners 66 of the trimmed foursquare antenna element. This is theorized to have an effect on the frequency response. In practice all of the elements may have ever so slightly rounded corners due manufacturing tolerances. FIG. 17 shows that in the extreme case of round trimming the corners which results in a circular element. While circular elements have the disadvantage that they do not fit together nicely in an array, there should be less capacitive coupling between the edges of circular elements which is an advantage.

Figure 18:
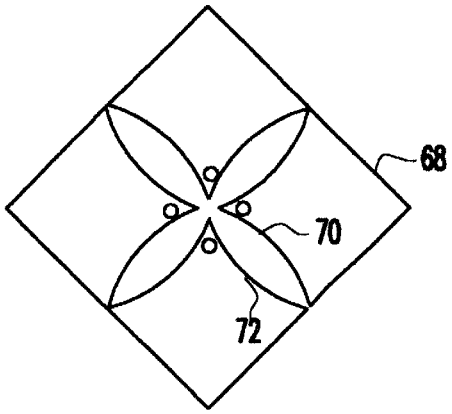
Figure 19:
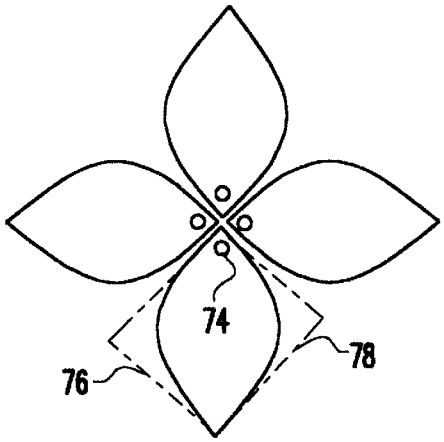
Figure 20:
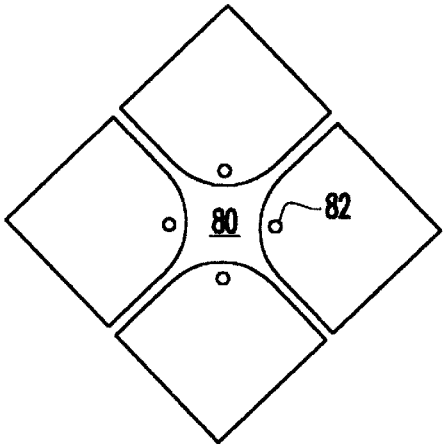
Figure 21:
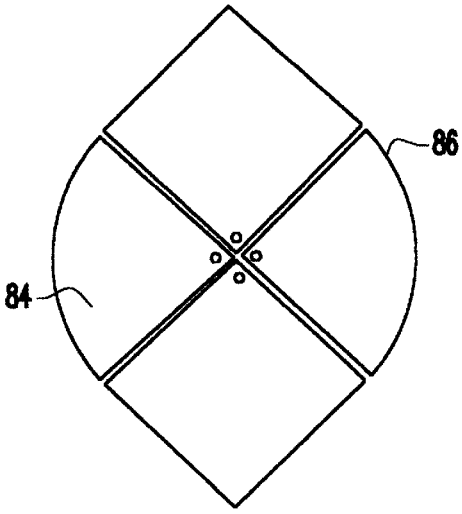

FIGS. 18–21 show various trimming configurations where other than the outer corners of the foursquare element are trimmed. FIG. 18 shows adjacent sides, 70 and 72, of the individual petals 68 are trimmed, This results in irregular spacing between the individual petals 68. FIG. 19 shows the corners 76 and 78 perpendicular to the feed points 74 trimmed. FIG. 20 shows the inner petal corners 80 near the feed points 82 trimmed. FIG. 21 shows a configuration having only two opposing corners 84 and 86 trimmed.

Figure 22:
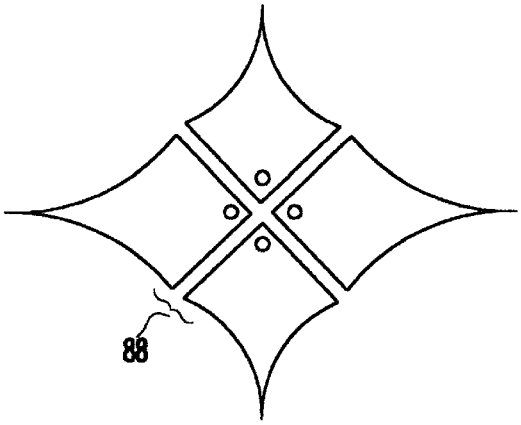

FIG. 22 shows a trimmed foursquare with a concave 88 curvature on the sides. This configuration would have the beneficial effect in an array of reducing the coupling between adjacent elements. This could also be used to optimize the frequency response of an individual element.

Figure 23:
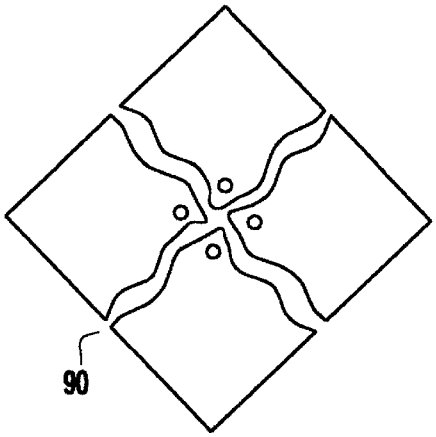
Figure 24:
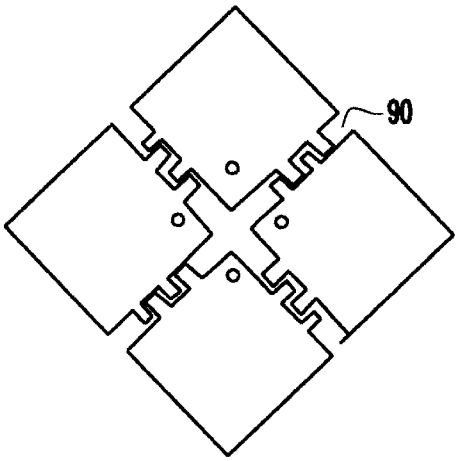

FIG. 23 shows a trimmed foursquare where the gaps 90 in the element are generally curved instead of straight. Similarly, in FIG. 24, the gaps 90 could be made in a zig zag or meandering pattern. This would have the effect of increasing the capacitance between the petals.

Figure 25:
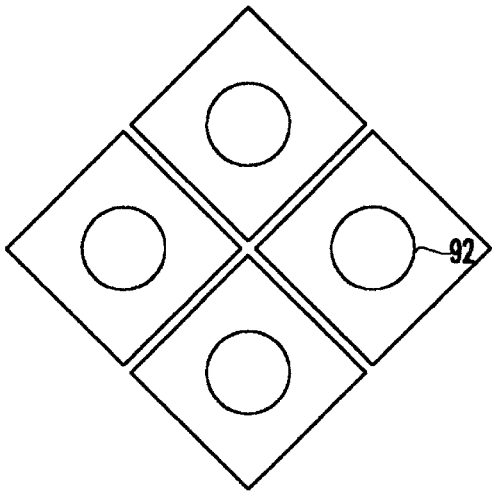
Figure 26:
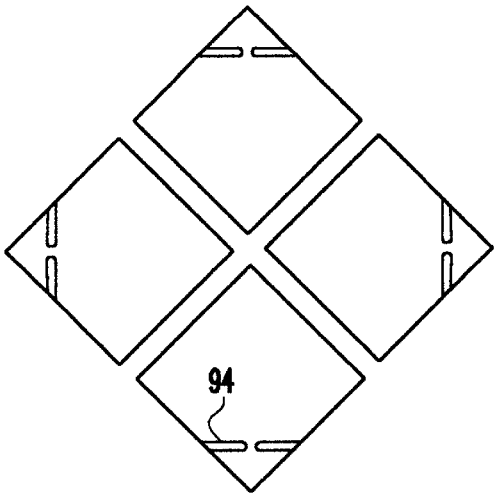
Figure 27:
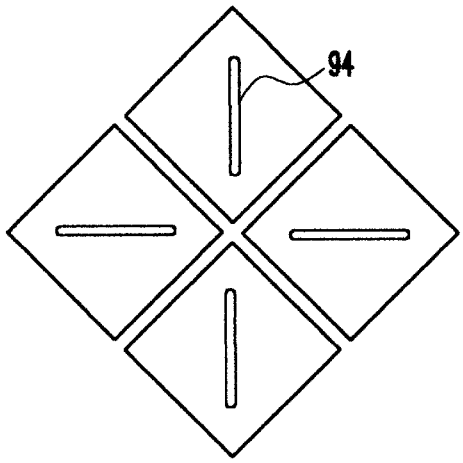
Figure 28:
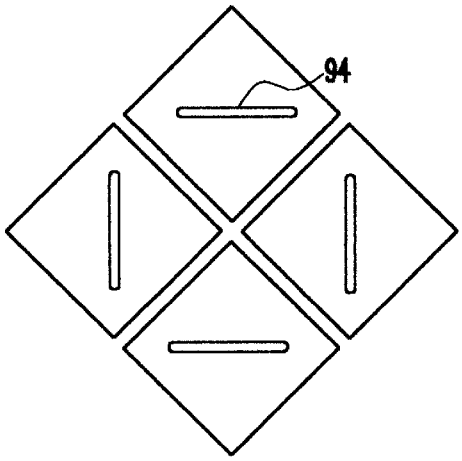
Figure 29:
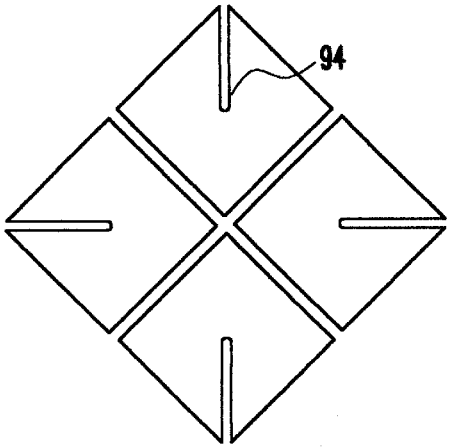

FIGS. 25–29 show the foursquare element having slots trimmed into the petals. As shown in FIG. 25, the slots may be circular 92. As shown in FIGS. 26–29, the slots may be longitudinal 94 and may be located in a variety of locations on the petals. Here, the slots in the petal metal control the way the current flows to modify the performance parameters and improve the frequency response of the antenna.

Figure 30:
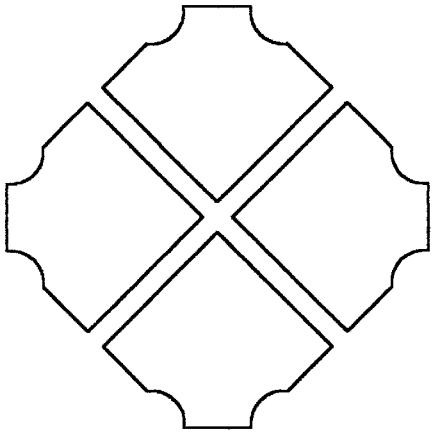
Figure 31:
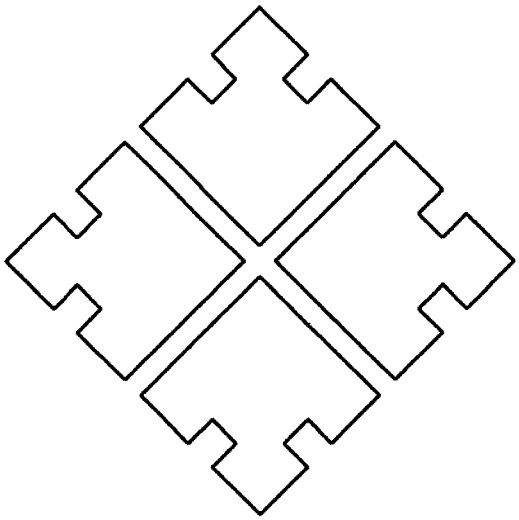
Figure 32:
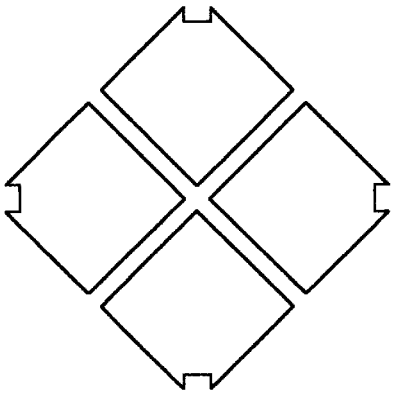

FIGS. 30–32 show placing notches in the edge of the petals to modify its shape. The notches are similar in idea to the slots shown above in FIGS. 25–29. The purpose of the notches is to control the flow of current to improve the frequency response of the element.

Figure 33:
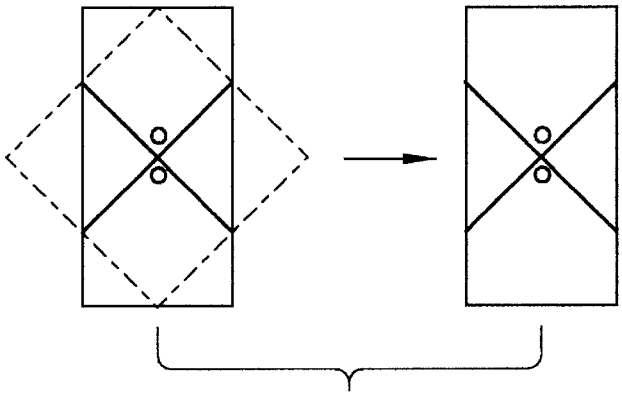
Figure 34:
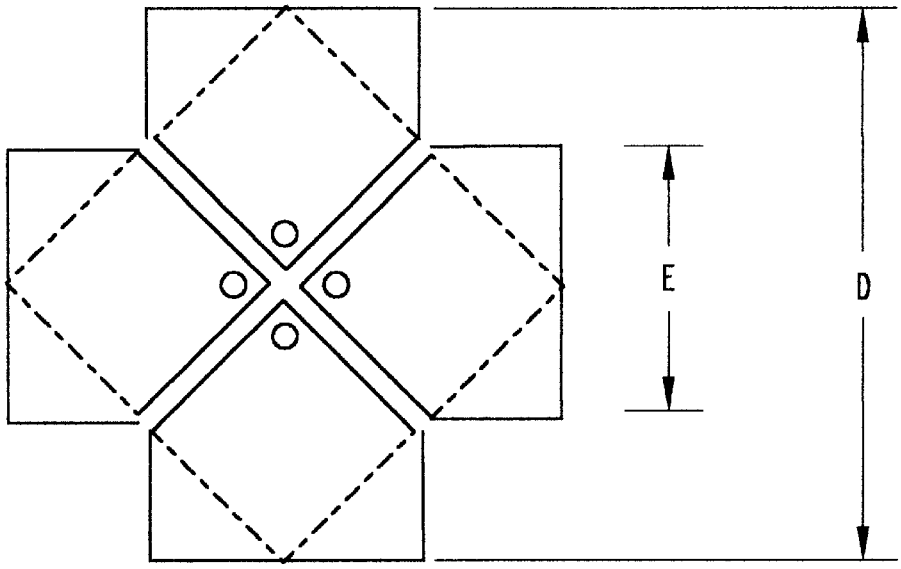

FIG. 33 extends the trimmed foursquare by adding metal to the active petals of the element so that the element becomes rectangular in shape. Better performance over the trimmed foursquare shown in FIG. 8 is expected. The element will take up slightly more area than the trimmed foursquare for the same operating frequency range. Similarly, FIG. 34 shows a "fat-cross" foursquare antenna configuration. Note that the length to width ratio is 2, that is, D/E=2. Thus this ratio is the same as the original foursquare design as illustrated by the dashed lines therefore similar performance is expected.

Figure 35:
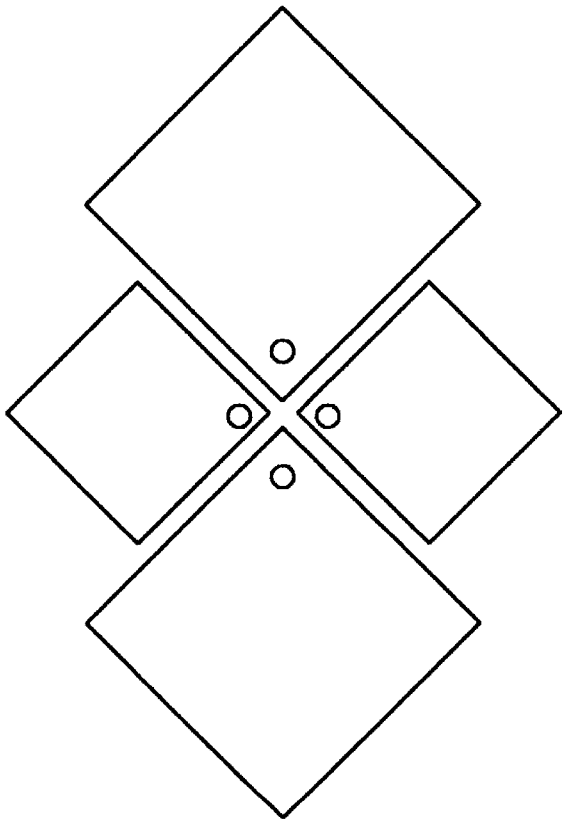

FIG. 35 shows a variation of the foursquare antenna where the pairs of radiating elements are different sizes since the outer sides of one pair of radiating elements have been trimmed. This arrangement also allows for a greater size in the vertical dimension.

While the invention has been described in terms of a several preferred embodiments, those skilled in the art will recognize that the invention can be practiced with modification within the spirit and scope of the appended claims.

We claim:

1. An antenna element, comprising:

a dielectric layer;

four radiating elements comprising two pairs positioned over a top side of said dielectric layer, said pairs positioned diagonal to each other, a first of said pairs comprising square radiating elements and a second of said pairs comprising square radiating elements each having at least one corner trimmed; and at least two feed points located near an inner corner of one of said first and second pairs.

2. An antenna element as recited in claim 1 wherein said outer corner is round trimmed.

3. An antenna element as recited in claim 1 wherein said square radiating elements of said first pair comprises at least one trimmed corner.

4. An antenna element as recited in claim 1 further comprising a ground plane positioned under said dielectric layer, wherein a spacing between said ground plane and said radiating elements is approximately one fourth of a wavelength at a maximum frequency.

5. An antenna element as recited in claim 1 wherein two feed lines connect to said two feed points and extend through vias in said dielectric layer.

6. An antenna element as recited in claim 1 wherein said four radiating elements are separated from adjacent ones of said four radiating elements by a distance W and wherein a diagonal D across said pairs is approximately one-half wavelength at a lowest operating frequency.

7. An antenna element, comprising:

a dielectric layer;

four radiating elements comprising two pairs positioned over a top side of said dielectric layer, said pairs positioned diagonal to each other, a first of said pairs comprising radiating elements each having at least two perpendicular sides and a second of said pairs comprising at least two radiating elements each having at least two perpendicular sides; and at least two feed points located near an inner portion of one of said first and second pairs.

8. An antenna element, comprising:

a dielectric layer;

four quadrilateral radiating elements comprising two pairs positioned on a top side of said dielectric layer, said pairs positioned diagonal to each other;

four feed lines, one of said four feed connecting to a feed point on a corresponding one of said four quadrilateral radiating elements; and a slot positioned on each of said four quadrilateral radiating elements.

9. An antenna element as recited in claim 8 wherein said slot is circular.

10. An antenna element as recited in claim 8 wherein said slot is longitudinal.

11. A scannable array of radiating elements, comprising:

a plurality radiating elements arranged in a geometrically shaped array; and controller means for controlling a phase and amplitude of feeds to each of said radiating elements, each of said radiating elements comprising:

four metalized radiating elements arranged in a four-square pattern, each of said four metalized radiating elements having at least two perpendicular sides; and at least one pair of feed points, connected to opposing ones of said four metalized radiating elements.

12. A scannable array of radiating elements as recited in claim 11 wherein each of said radiating elements further comprises:

a dielectric layer beneath said metalized radiating elements, a ground plane beneath said dielectric layer; and vias through said dielectric layer to connect said feeds to said feed points.

13. A scannable array of radiating elements as recited in claim 11 wherein each of said radiating elements is comprise at least one square corner.

* * * * *